US005666911A

United States Patent [19]

Gohl et al.

[11] Patent Number: 5,666,911

[45] Date of Patent: Sep. 16, 1997

[54] COOLING SYSTEM FOR A LIQUID-COOLED INTERNAL COMBUSTION ENGINE

[75] Inventors: Hans-Dieter Gohl, Stuttgart; Hans-Martin Haase, Neuhausen, both of Germany

[73] Assignee: Mercedes-Benz AG, Stuttgart, Germany

[21] Appl. No.: 728,341

[22] Filed: Oct. 9, 1996

[30] Foreign Application Priority Data

Oct. 13, 1995 [DE] Germany ..... 195 38 239.0

[51] Int. Cl.[6] ..... F01P 3/22

[52] U.S. Cl. ..... 123/41.54; 123/41.29

[58] Field of Search ..... 123/41.54, 41.29; 237/12.3 B

[56] References Cited

FOREIGN PATENT DOCUMENTS

| | | |
|---|---|---|
| 0 532 416 | 3/1993 | European Pat. Off. . |
| 0 561 673 | 9/1993 | European Pat. Off. . |
| 1 125 233 | 3/1962 | Germany . |
| 28 27 022 | 1/1979 | Germany . |
| 34 33 370 | 1/1989 | Germany . |
| 41 31 357 | 7/1992 | Germany . |
| 41 01 708 | 8/1992 | Germany . |
| 43 08 002 | 8/1994 | Germany . |

*Primary Examiner*—Noah P. Kamen
*Attorney, Agent, or Firm*—Klaus Bach

[57] ABSTRACT

In a cooling system for a liquid-cooled internal combustion engine including a radiator with a water box on top of the radiator, an inlet for receiving coolant heated in the engine, an outlet for returning coolant cooled in the radiator to the engine, an expansion tank disposed in communication with the radiator and a vehicle heater with a hot coolant supply line extending from the engine to the vehicle heater, the hot coolant supply line is flow-connected to the expansion tank for venting gases from the supply line to the expansion tank.

11 Claims, 3 Drawing Sheets

COOLING SYSTEM FOR A LIQUID-COOLED INTERNAL COMBUSTION ENGINE

BACKGROUND OF THE INVENTION

The invention relates to a cooling system for a liquid-cooled internal combustion engine including a radiator with a water box having an inlet for receiving coolant heated in the engine and an outlet for returning the cooled coolant to the engine, an expansion tank in communication with the radiator and a vehicle heater with a supply and a return line.

DE 34 33 370 C2 discloses a cooling system of a liquid cooled internal combustion engine including a radiator having a water box with coolant inlet and outlets disposed at the bottom of the radiator. An expansion tank is disposed at the top of the radiator in flow communication therewith. The inlet side of the radiator is in communication with a discharge nozzle for coolant heated in the engine and the discharge side is in communication with a coolant pump. Furthermore, the cooling system includes a vehicle heater with supply and return lines through which engine-heated coolant is circulated through the heater.

For general background information, further reference is made to patent publications DE 41 31 357 C1, DE 41 01 708 708 A1 and DE 28 27 022 A1.

The cooling circuits disclosed in these publications have the disadvantage that they are relatively complicated and require a relatively large number of various coolant flow and vent connections between the engine, the radiator and other heat exchangers (such as vehicle heater, oil cooler and auxiliary cooler). Furthermore, the relatively complicated arrangement of the coolant and vent lines is often the result of demands on the cooling circuit concerning the cooling of particular components. Furthermore, requirements concerning the venting of the cooling circuit particularly during vehicle operation and also, at the same time, important other aspects such as filling and draining of the cooling circuit with coolant must be taken into consideration such that they can be adequately satisfied.

It is the object of the present invention to provide a cooling system with a coolant flow control in such a way that the cooling system is relatively simple and inexpensive and also compact in design while all desirable properties concerning coolant control, venting, filling and draining are maintained.

SUMMARY OF THE INVENTION

In a cooling system for a liquid-cooled internal combustion engine including a radiator with a water box on top of the radiator, an inlet for receiving coolant heated in the engine, an outlet for returning coolant cooled in the radiator to the engine, an expansion tank disposed in communication with the radiator and a vehicle heater with a hot coolant supply line extending from the engine to the vehicle heater, the hot coolant supply line is flow-connected to the expansion tank or to the water box for venting gases from the supply line to the expansion tank.

The arrangement according to the invention has the advantage that venting of the coolant in the engine block is achieved via the supply line for the vehicle heater in the expansion tank or in the water box of the radiator so that no separate vent duct is required for the continuous venting of the engine. The elimination of the separate vent duct results in a reduction of the design expenses and provides for a more compact cooling circuit arrangement.

If the heater coolant supply line extends through the expansion tank the arrangement is particularly compact since this eliminates the need for a heater supply line which bypasses the expansion tank and the water box, that is, the radiator and engine venting is effectively accomplished in the expansion tank.

If the radiator is provided with a lower water box in which the coolant flow is only reversed and the upper water box includes a divider wall providing for an inlet chamber to which the hot coolant line from the engine is connected and an outlet chamber to which the return coolant line for returning the cooled coolant to the engine is connected, the coolant flows through the radiator in a U-shaped pattern. Such an arrangement is relatively inexpensive since the return lines of the radiator and the vehicle heater are shorter than they would be if they were connected to the lower water box and they are, furthermore, easily accessible for inspection and replacement.

A particularly compact design is obtained if the expansion tank is integrated with the upper water box of the radiator and is in direct communication with the upper water box. Integration of the expansion tank with the radiator is achieved for example by a plug-in connection wherein the expansion tank is disposed on top of the upper water box and becomes an integral part of the radiator.

Venting may then be achieved by means of a funnel-like structure in the bottom of the expansion tank by which the expansion tank is in flow communication with the upper water box.

The coolant return line from the vehicle heater may simply be connected to the expansion tank or the upper water box in an area from which the coolant is returned to the pump. This arrangement requires only a single coolant return line connection to the engine as the coolant returning from the vehicle heater is returned to the coolant pump through the radiator coolant return line. In this manner, also, the occasionally occurring back flow of coolant returning from the vehicle heater into the radiator through the radiator return flow line is prevented.

Preferably, the coolant return line from the radiator to the engine includes also a filler neck so that coolant can be added to the cooling system through the coolant return line to the engine and no separate refill conduit leading to the suction side of the water pump or directly to the engine block as it is often provided in state of the art designs is needed.

The invention is described in greater detail on the basis of the accompanying drawings.

DESCRIPTION OF PREFERRED EMBODIMENTS

Figure 1:
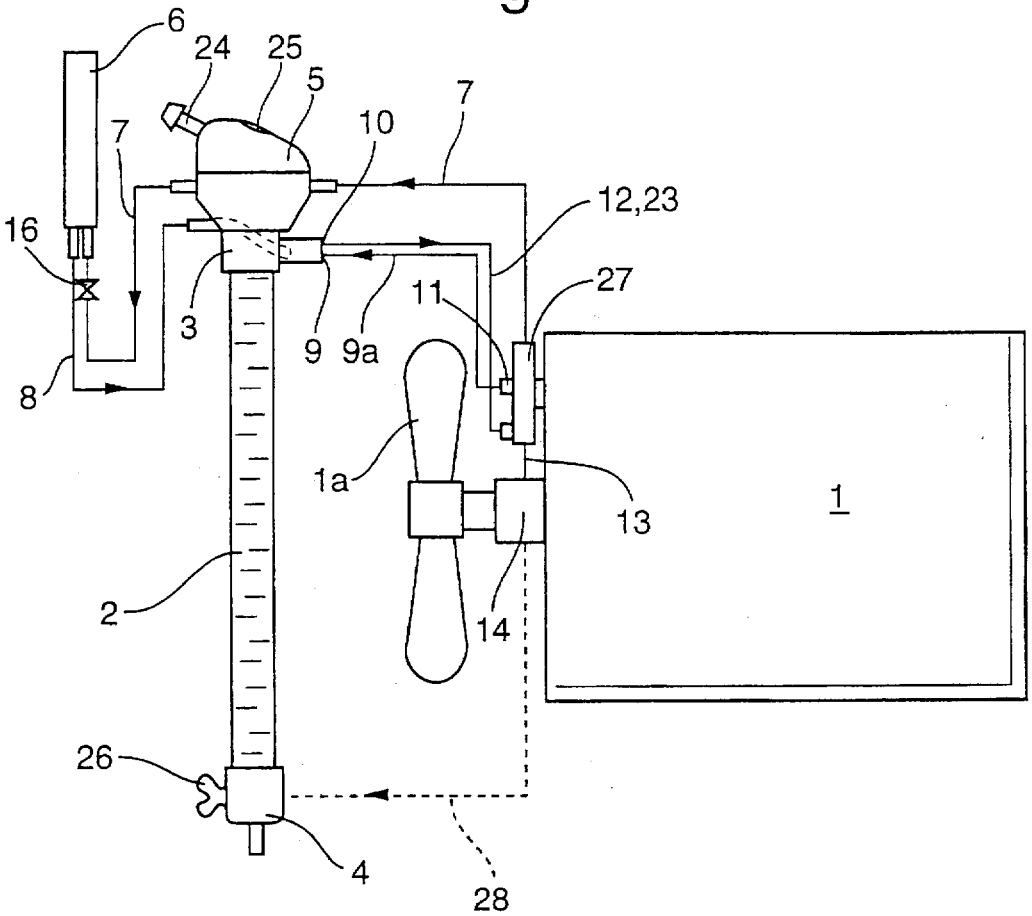
FIG. 1 is a schematic side view of the cooling system according to the invention showing engine and radiator.
Figure 2:
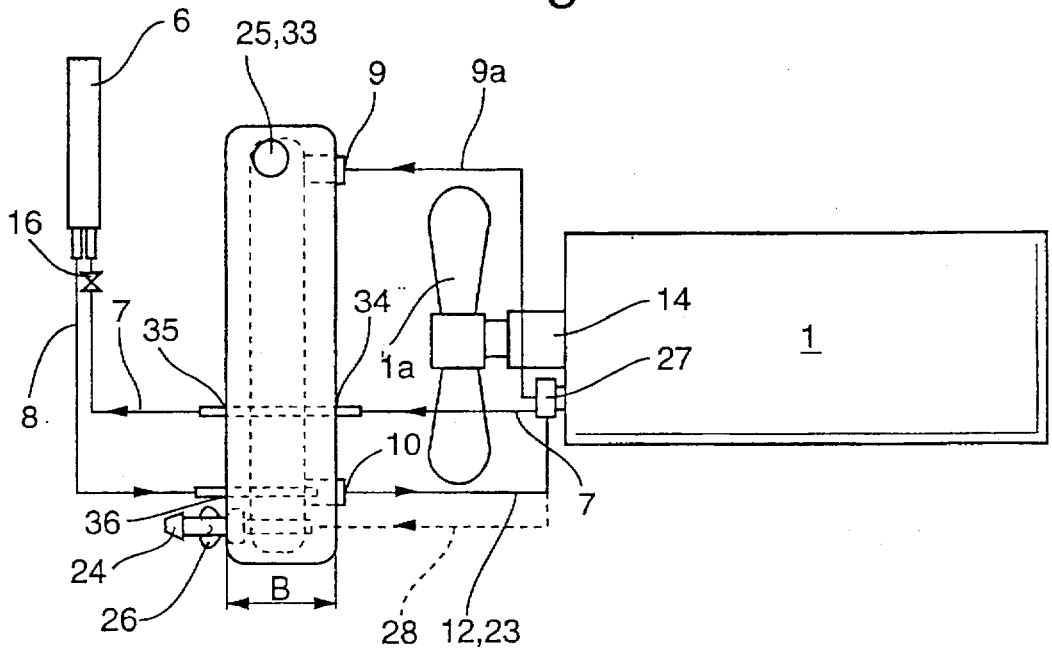
FIG. 2 is a top view of the arrangement shown in FIG. 1.

FIGS. 1 and 2 are schematic representations of a cooling system according to the invention with a coolant flow circuit for a liquid cooled internal combustion engine including an engine block 1, a cooling air fan 1*a*, and a radiator 2 arranged in front of the cooling air fan 1*a*. The radiator 2 includes—in a position as installed in a vehicle— an upper water box 3 and a lower flow reversing water box 4, the water box 3 being in flow communication with an expansion tank 5. The cooling circuit further includes a vehicle heater 6 with a supply line 7 and a return line 8.

The flow directions for the coolant through the connecting lines between the engine block 1, the radiator 2 with expansion tank 5 and the vehicle heater are indicated by arrows.

The flow of coolant from the engine block to the rest of the cooling system and back to the engine block is controlled by a coolant flow controller 27 which includes a thermostat operating basically in a well known manner for controlling the engine operating temperature. For simplification reference will be made below to the return of coolant to, and the supply of hot coolant from, the engine block without always referring to the coolant flow controller 27.

The water box 3 of the radiator 2 includes a coolant inlet 9 and a coolant outlet 10. The coolant inlet 9 is in communication with an outlet nozzle 11 of the coolant flow controller 27 by way of a conduit 9*a* for receiving coolant heated in the engine and the coolant outlet 10 is in communication, by way of a conduit 12, with an inlet nozzle 13 of a coolant circulating pump 14 arranged in the cooling circuit to pump coolant cooled in the radiator 2 into the coolant channels of the engine block 1.

The coolant supply line 7 for the vehicle heater 6 extends through the expansion tank 5 and is connected to another outlet nozzle of the coolant flow controller 27. For controlling the vehicle heater 6, the coolant supply line 7 includes a valve 16 which is operated by a controller (not shown) for controlling the temperature in the vehicle passenger compartment.

The radiator 2 and the engine block 1 have a venting arrangement which will be described in detail below.

Venting of the engine block 1 during filling of the cooling systems and also during engine operation occurs by way of a vent opening 15 arranged in the supply line 7 (see FIGS. 3 and 4) and opening into the expansion tank 5. Alternatively, the vent opening 15 may be arranged in the water box 3 of the radiator 2.

Venting of the engine block 1 may also be provided for, in place of the simple vent opening 15 as described above, by a venting arrangement such as a radial vent as shown for example in FIG. 5 and described below in greater detail (vent cyclone).

The conduit 12 which extends between the coolant outlet side 10 of the radiator 2 and the inlet nozzle 13 of the water pump 14 also serves as a fill pipe 23 for adding coolant. Accordingly, the fill pipe 23 is functionally integrated into the conduit 12 extending between the radiator coolant outlet side and the engine inlet.

With the conduit configuration according to the invention wherein the fill pipe 23 is integrated into the connecting conduit 12 extending from the radiator 2 to the engine block 1, a separate fill line extending between the expansion tank 5 and the suction side of the water pump 14 is omitted.

Figure 3:
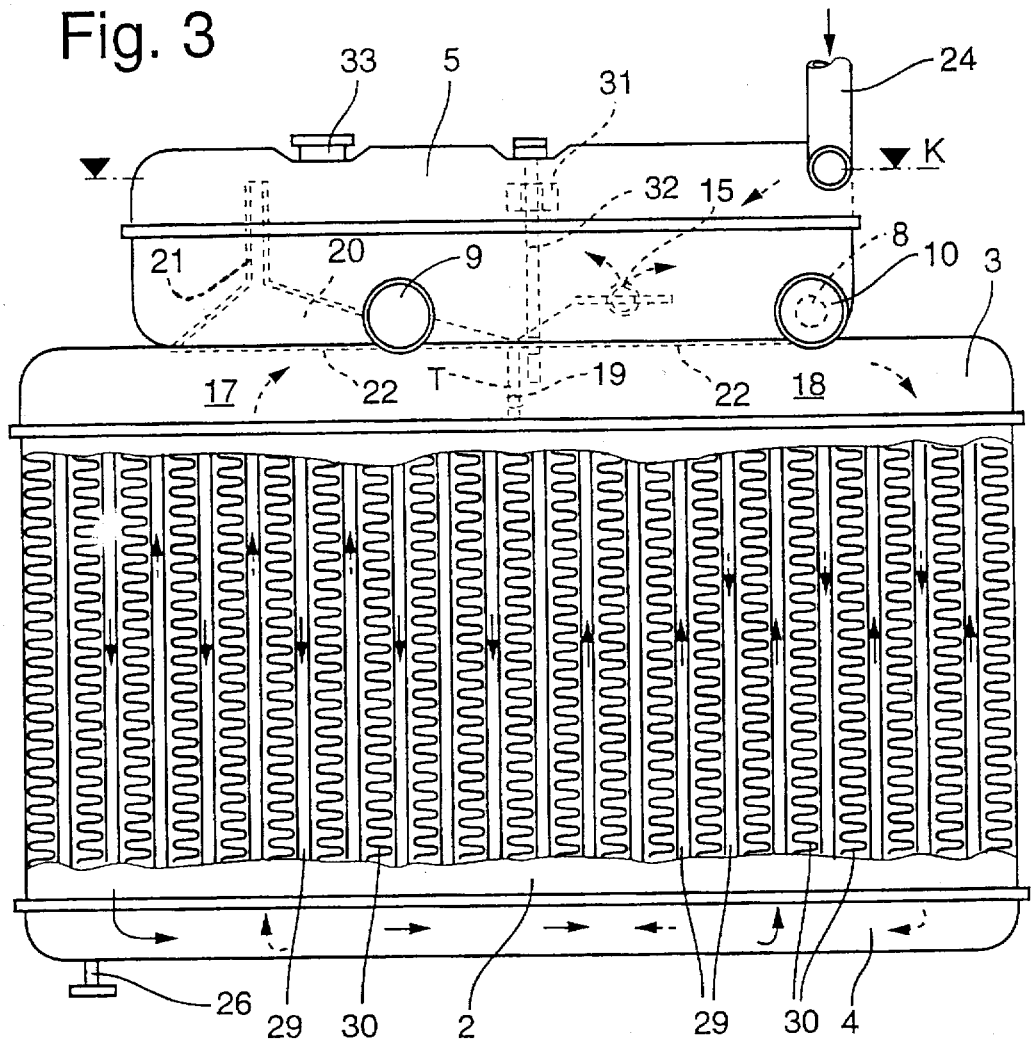
FIG. 3 shows a radiator with an expansion tank mounted on its top.

The upper water box 3 of the radiator 2 is divided into two chambers 17, 18 by a separating wall T extending over the width B of the radiator (see FIGS. 3 and 4), the inlet 9 opening into the one chamber 17 and the outlet 10 into the other chamber 18. Because of the separating wall T and the position of the inlet 9 and the outlet 10 and because of the lower flow reversing box 4 the coolant flows through the radiator 2 in a U-shaped pattern as it is indicated in FIG. 3 by the arrows.

The two chambers 17, 18 are in communication by way of a vent opening 19 (see FIGS. 3 and 4) that is, for example a well defined annular gap in order to insure radiator venting, to facilitate a geodetical level adjustment of the coolant in the chambers 17 and 18 and, when applicable, to provide for a certain engine speed dependent short circuit flow of coolant from the chamber 17 to the chamber 18 (for the reduction of pressure losses).

At the lower flow reversing water box 4, there is a drain screw 26 which permits the drawing of coolant from the radiator and also from the engine. An engine drain line 28 which extends from the coolant inlet to the engine (or the housing of a coolant flow controller 27) to said drain screw 26 is shown by a dashed line.

The return line 8 of the vehicle heater 6 extends to the expansion tank 5. In order to prevent an objectionable flow of coolant from the heater return line 8 into the radiator, the discharge nozzle of the return line 8 is so arranged in the expansion tank 5 that it extends into the inlet of the conduit 12 leading to the coolant circulating pump 14 so that the coolant returning from the vehicle heater 6 is added directly to the cooled coolant flow returning to the water pump 14.

Figure 4:
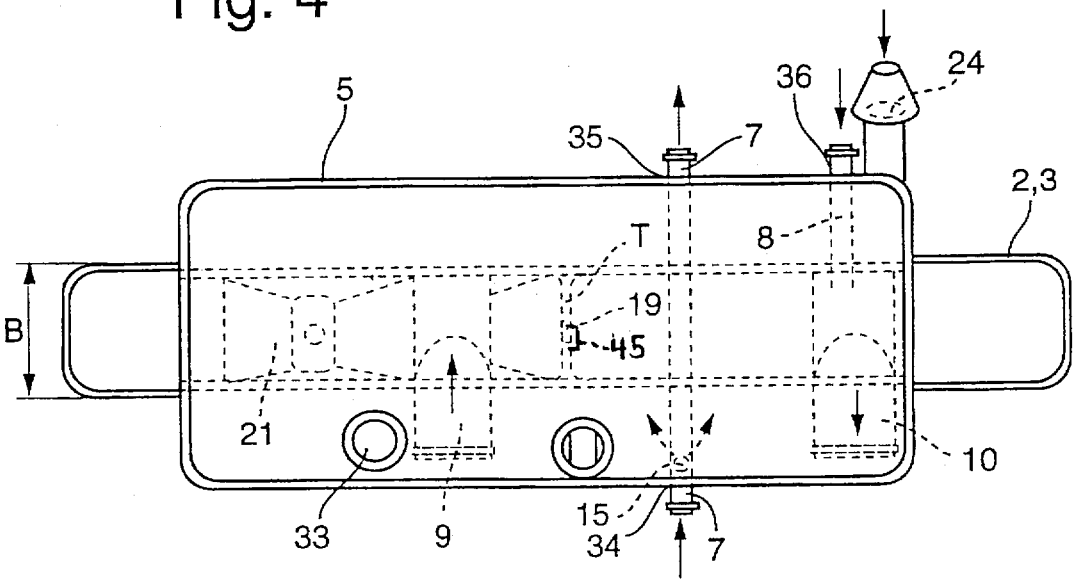
FIG. 4 is a top view of the arrangement shown in FIG. 3.

FIGS. 3 and 4 show, in principle, the radiator 2 with an upper water box 3 and a lower flow-reversing water box 4 as well as the expansion tank 5 integrated with the upper water box 3. Corresponding components are indicated by the same reference numerals used in FIGS. 1 and 2.

As known in principle, the radiator 2 includes a plurality of vertical tubes 29 providing for flow connection between the upper water box 3 and the lower flow reversing water box 4. To increase the cooling surface cooling fins 30 are disposed between the tubes, FIG. 3 showing only some of the tubes 29 and the cooling fins 30.

The expansion tank 5 includes, in addition to the components described earlier, a float 31 with a float guide 32, the float being connected to a signaling device (not shown) for indicating the coolant level. Furthermore, the expansion tank 5 includes a filler nozzle 24 and a nozzle 33 for a single or multiple stage excess pressure valve 25 (see FIG. 1) and openings 34, 35 through which the supply line 7 extends and further an opening 36 for the return line 8 from the vehicle heater 6. The expansion tank 5 is integrated with the upper water box 3 of the radiator 2 by an injection molding technique interconnecting the two components. A practical form for such an interconnection is shown in FIG. 5.

For a better understanding of the invention the operation of the cooling circuit arrangement will be described for various operating phases of the cooling system.

The cooling system is filled by way of the filler nozzle 24 of the expansion tank 5. The amount of coolant filled into the system is limited by a mechanical limiter which is not shown so that an expansion volume remains in the expansion tank 5 as required for the operation of the cooling circuit (coolant level K).

From the expansion tank 5, the coolant flows into the chamber 18 of the water box 3 by way of a connecting channel which is not specifically shown and fills the U-shaped radiator 2 (dashed arrows) up to the nozzle level of the inlet 9 and the outlet 10. Then the coolant overflows into the inlet and outlet pipes at the inlet 9 and the outlet 10 and fills the cooling channels in the engine block 1 by way of the conduits 9*a* and 12 (see FIGS. 1 and 2). The conduit interconnecting the radiator 2 and the expansion tank 5 is formed as a plug-in or hose connection and may be used at the same time for supporting the expansion tank.

Venting of the coolant flow in the expansion tank 5 is achieved by way of a vertical vent channel 21 at the bottom 22 of the expansion tank 5 such that gas enclosures are discharged through the vent channel 21 which is sized to accommodate the amount of gases to be vented, the vent channel 21 being in communication with the water box 3.

Venting of the radiator 2 is achieved by way of a funnel-like structure 20 in connection with the vent channel 21 at the bottom 22 of the expansion tank 5. As mentioned already earlier the vent channel 21 is in communication with the upper water box 3. The funnel-like structure 20 and the vertical vent channel 21 are designed to accommodate the vent volume of the radiator 2. Furthermore, venting of the radiator 2 and of the cooling channels of the engine block 1 during filling and also during operation may also by way of the vent opening 19 formed in the separating wall T and by way of the vent opening 15 in the supply line 7.

When the vehicle heater is in operation (valve 16 is open) the coolant in the heater supply line which is integrated into motor vent system flows to the heater 6, whereby at the same time the functions mentioned earlier (radiator venting and gas separation) are accomplished.

The heater coolant returns via the return line 8 and the expansion tank 5, the return line 8 in the expansion tank 5 extending into the outlet 10 for the conduits 12 or 23. In order to reduce energy losses in the coolant return flow the heater return line 8 extends to the outlet 10 as directly as possible with little flow deflections (see FIGS. 2 and 4).

Figure 5:
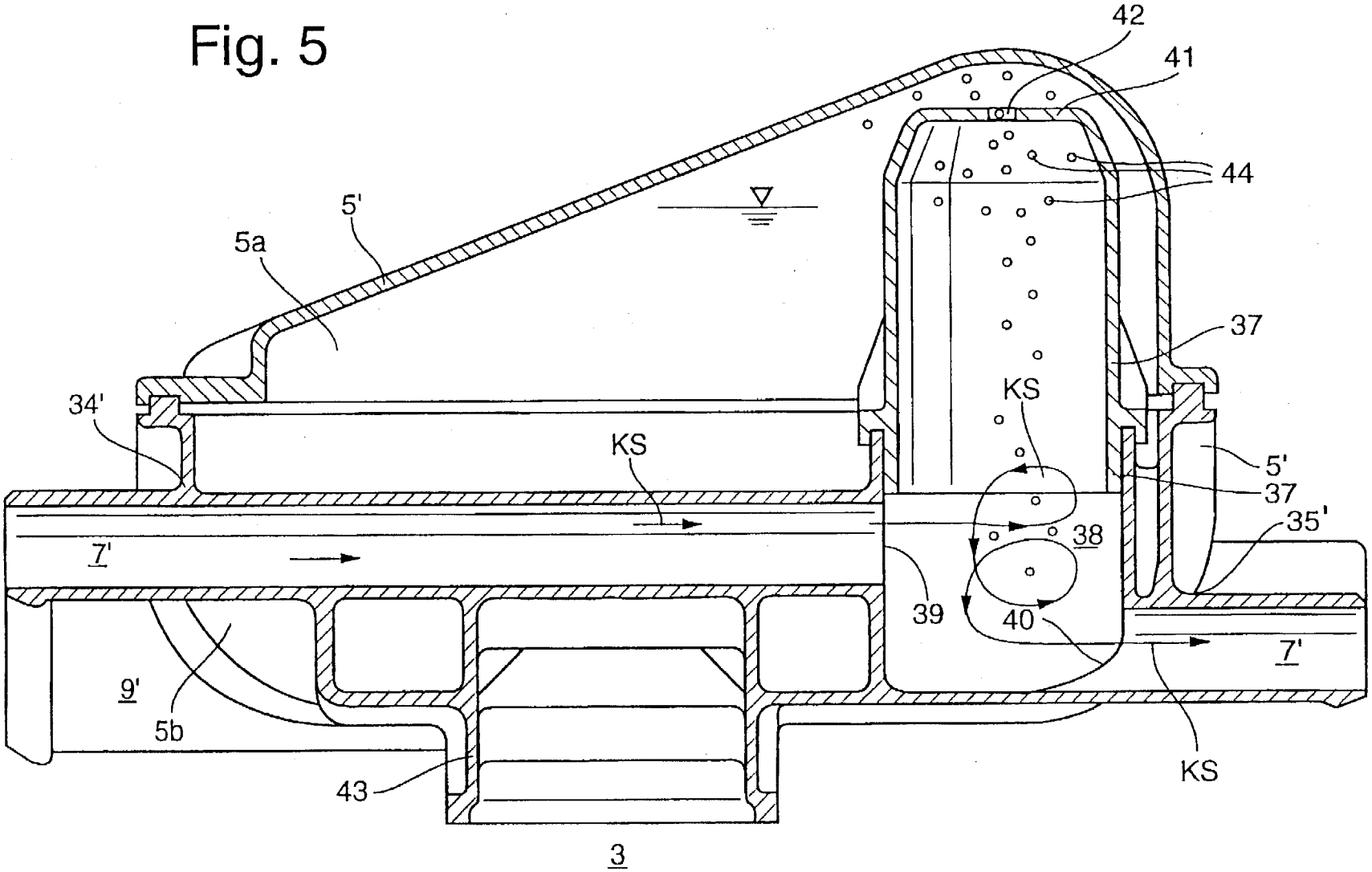
FIG. 5 shows an embodiment of an expansion tank with an integrated venting arrangement.

As mentioned already earlier, FIG. 5 shows an embodiment of the invention wherein an expansion tank 51 is provided with an integrated venting structure in the form of a radial vent (vent cyclone). This venting arrangement is particularly suitable for engine venting systems which are always activated. Components already described in connection with FIGS. 1 to 4 and merely changed in design but functionally unchanged are designated by the same reference numerals provided however with apostrophes, for example, the inlet 9' and the openings 34' and 35' for the passage of the supply line 7'.

The expansion tank 5' comprises an upper part 5*a* and a lower part 5*b* which are sealingly interconnected. When ready for operation, the coolant level of the cooling circuit in the upper part 5*a* of the expansion tank 5' is about at the level as shown in FIG. 5. The expansion tank 5' is integrated with the upper water box 3 of the radiator 2 (see FIG. 1) by way of a connection 43 obtained by an injection molding technique.

The radial vent is disposed in the expansion tank 5' and comprises a two-part cylindrical housing with a lower housing part 38 and an upper housing part 37. The lower housing part 38 is injection molded onto the lower part 5*a* of the expansion tank 5' and the upper housing part 37 is sealingly inserted onto the lower housing part 38.

The upper housing part 37 has a cylinder cover 41 closing the two-part housing at the top, the cover 41 being provided with a central opening 42 which provides for communication between the interior of the housing and the interior of the expansion tank 5'. The lower housing part 38 has an about tangential inlet 39 for the supply line 7 and a tangential outlet 40 of the supply line 7' arranged diametrically across from, but below, the inlet 39. The housing can therefore be considered to be part of the supply line 7'. The lower part 5*a* of the expansion tank 5' has parts of the supply line 7' integrally injection molded therewith. Consequently, the lower part 5*a* of the expansion tank 5' represents an integrated injection molding component into which the sections of the supply line 7', the lower housing part 38 and the connection 43 between the water box 3 of the radiator 2 are injection molded.

The coolant KS flows through the supply line 7' in the same manner as shown in FIG. 1 on its way from the engine block 1 to the vehicle heater 6, the flow direction of the coolant being indicated by arrows.

The venting of the coolant flow in the radial venting structure is effected as follows: the coolant KS enters the cylindrical housing in a tangential manner by way of the tangential inlet 39 and leaves the housing by way of the tangential outlet 40 which is disposed at a lower level than the inlet 39. The tangential inlet flow and the tangential inlet flow flow generate in the cylindrical housing (at least between the inlet and the outlet) a swirling flow by which the coolant flow is forced toward the cylindrical walls of the housing by centrifugal forces. This forces the light-weight gas bubbles 44 to the center of the housing where they raise to the surface and escape from the cylindrical housing through the vent opening 42 in the cylinder housing cover 41. In order to achieve good operation of the radial vent structure, particularly the area of the housing between the tangential inlet and outlet openings 39, 40 should be cylindrical so that the flow swirling action described above is safely achieved.

In the embodiment as shown the supply line 7 for the vehicle heater extends through the expansion tank; but it may as well extend through the upper water box of the radiator.

In another embodiment of the invention, the return line 8 may also extend into the upper water box 3 of the radiator and in an analog manner, the conduit 12 may lead from the water box 3 to the engine block 1.

In a further embodiment of the invention, the chambers 17 and 18 of the upper water box 3 may be interconnected by a pressure responsive element 45 for generating a short circuit for the coolant when the pressure differential between the chambers 17 and 18 exceeds a predetermined value. The pressure responsive element may be responsive to the pressure differential in such a manner that the degree of opening changes with changing pressure differential such that the opening is larger with a greater pressure differential than it is with a smaller pressure differential.

What is claimed is:

1. A cooling system for a liquid cooled internal combustion engine comprising a radiator with at least one water box, an inlet for receiving coolant heated in said engine, an outlet for returning coolant cooled in said radiator back to said engine, an expansion tank disposed in fluid communication with said radiator, a vehicle heater with a hot coolant supply line extending from said engine to said vehicle heater for supplying hot coolant thereto and a coolant return line for returning coolant from said heater to said engine, and a venting system for venting gases from said cooling system, said venting system utilizing said hot coolant supply line for venting gases from said engine and said hot coolant supply line having a vent opening in communication with at least one of said expansion tank and said water box for venting gases from said coolant supply line.

2. A cooling system according to claim 1, wherein said hot coolant supply line for said vehicle heater extends through at least one of said expansion tank and said water box and has said vent opening arranged therein.

3. A cooling system according to claim 1, wherein said water box is disposed on top of said radiator and coolant inlets and outlets are provided on said water box at the top of said radiator.

4. A cooling system according to claim 3, wherein said water box at the top of said radiator includes a separating wall dividing said top water box into a first chamber having said coolant inlet and a second chamber having said coolant outlet and a flow reversing water box is disposed at the bottom of said radiator such that the coolant flows in a U pattern from said first chamber down to said flow reversing water box at the bottom of said radiator and then up to said second chamber.

5. A cooling system according to claim 4, wherein said chambers in said upper water box are in communication by way of a pressure responsive communication element for generating a short circuit flow connection between said first and second chambers, said communication element being adapted to open depending on the pressure differential in said first and second chambers and having a predetermined minimum gap to permit venting during filling of the radiator.

6. A cooling system according to claim 1, wherein means for venting gases from said supply line are integrated into said expansion tank.

7. A cooling system according to claim 6, wherein said expansion tank includes a cyclone-type gas separator through which said supply line extends for separating gases therefrom and discharging them into said expansion tank.

8. A cooling system according to claim 1, wherein said expansion tank is formed integrally onto said upper water box and venting of said upper water box is by way of said expansion tank.

9. A cooling system according to claim 8, wherein a funnel-like communication structure is provided at the bottom of said expansion tank which is in communication with said upper water box and a vertical passage extends from said funnel-like structure upwardly for venting gases collected in said funnel-like structure, said vertical passage having a flow cross-section sized to accommodate the amount of gases collected in said funnel-like structure.

10. A cooling system according to claim 1, wherein said return line from said vehicle heater extends to the coolant inlet area of the coolant outlet for returning coolant to said water pump by admixing the coolant returning from said vehicle heater to the coolant returning to the engine.

11. A cooling system according to claim 1, wherein said conduit returning coolant from said radiator to said engine includes a fill pipe for filling said cooling system.

* * * * *